United States Patent [19]

Sorrells

[11] 4,341,045

[45] Jul. 27, 1982

[54] ADAPTER CHUCK FOR MOUNTING LENS BLANKS

[75] Inventor: Frank D. Sorrells, Knoxville, Tenn.

[73] Assignee: Cole National Corporation, Cleveland, Ohio

[21] Appl. No.: 207,924

[22] Filed: Nov. 18, 1980

Related U.S. Application Data

[62] Division of Ser. No. 44,991, Jun. 4, 1979, Pat. No. 4,267,672.

[51] Int. Cl.[3] ..... B24B 13/02

[52] U.S. Cl. ..... 51/216 LP; 51/277

[58] Field of Search ..... 51/216 R, 216 LP, 217 L, 51/277, 284 R, 284 E

[56] References Cited

U.S. PATENT DOCUMENTS 2,573,668 10/1951 Long et al. ..... 51/277

FOREIGN PATENT DOCUMENTS 1463508 2/1977 United Kingdom ..... 51/216 LP

*Primary Examiner*—Harold D. Whitehead

*Attorney, Agent, or Firm*—Fay & Sharpe

[57] ABSTRACT

A chucking method and apparatus for processing a lens blank in a manner requiring only a single mounting of the blank to an associated lens block. The lens block is mounted to the convex lens blank surface by a hot melt type of adhesive so as to extend outwardly thereof substantially coaxial with the lens blank frame center axis. The lens blank and lens block are releasably mounted in a chuck associated with lens surface generating apparatus such that the lens blank frame center axis and the tail stock of the generating apparatus are coaxial. The chuck includes means for selectively adjusting and rotating the lens blank relative to the tailstock for accommodating any desired decentration, axis setting and prism prescribed for the finished lens. Following generation of the desired optical characteristics in the lens blank, the blank and associated lens block are mounted and processed first in surface fining apparatus and then in peripheral edge contouring apparatus. In these operations, the lens blank frame center axis is disposed substantially coaxial with the associated apparatus tail stocks or chucks. An adaptor conveniently allows adjusting rotation of the lens blank about its frame center axis in the surface fining and polishing apparatus compatible to any degree of rotation accommodated during surface generation. Following lens blank edge contouring, the lens block is removed from mounted association with the finished optical lens.

9 Claims, 23 Drawing Figures

A
B
C
e
f
11
12
13
14
50
52
54
56
58
60
62
64
66
68
70
72
80
82
84
86
88
90
92
94
96
98
104
114
116
120
122
124
126
128
129
130
132
136
138
140
142
144
150
152
154
158
160
162
164
166
168
170
174
176
178
180
182
184
186
190
192
194
196
202
204
206
208
210
220
224
226
228

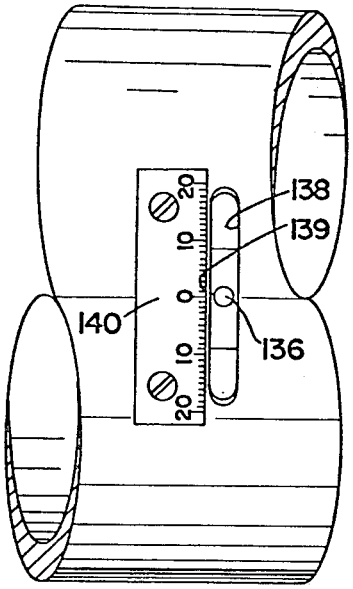
FIG. 15
FIG. 16
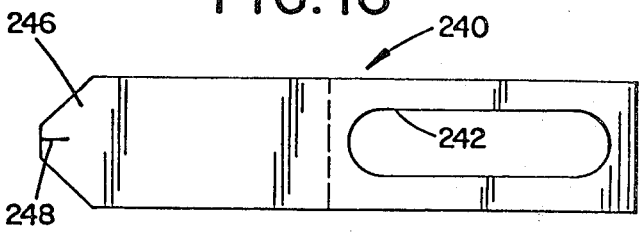
FIG. 18
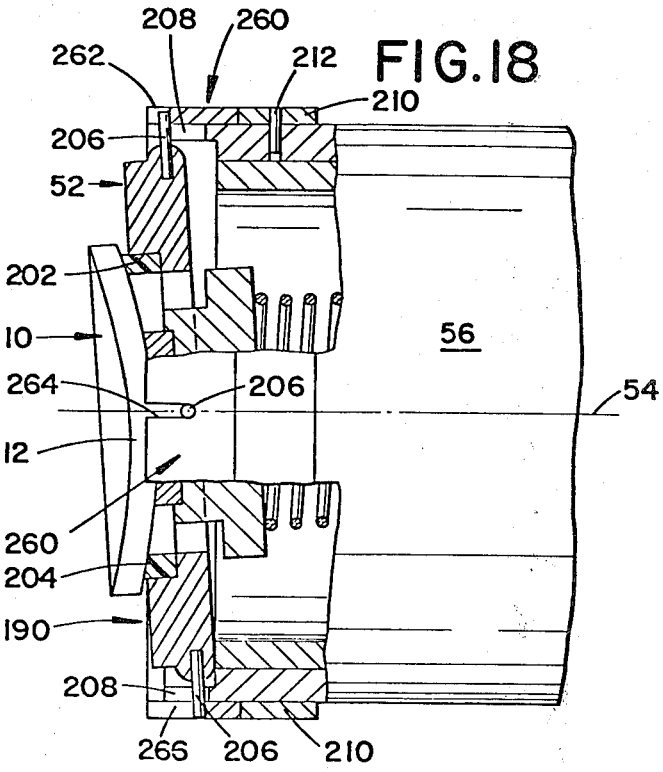
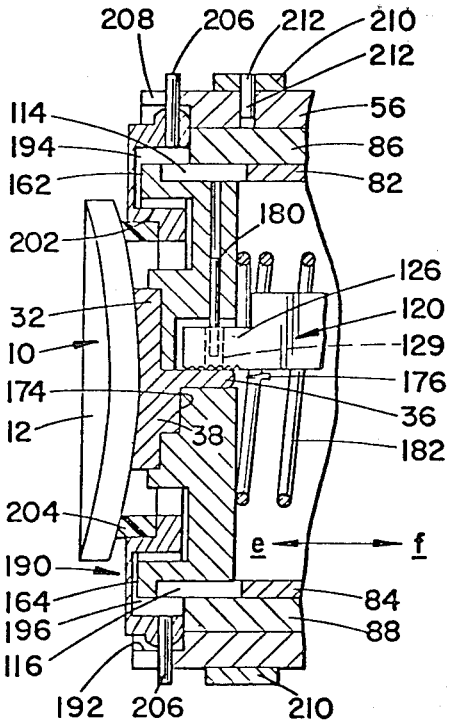
FIG. 17
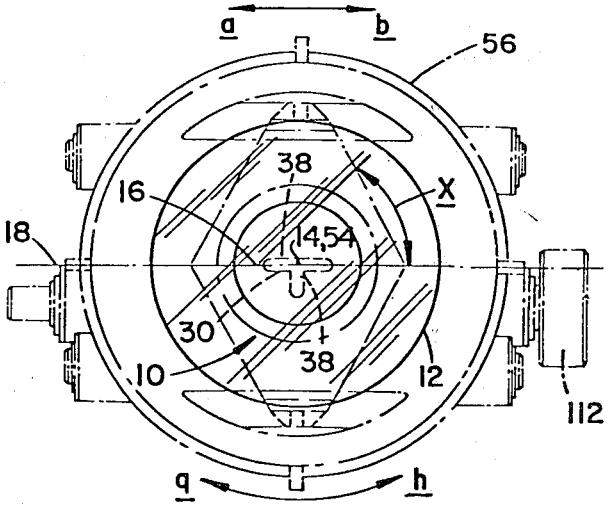
FIG. 19

ADAPTER CHUCK FOR MOUNTING LENS BLANKS

This application is a division of U.S. patent application Ser. No. 44,991 filed June 4, 1979, now U.S. Pat. No. 4,267,672 issued May 19, 1981.

BACKGROUND OF THE INVENTION

This application pertains to the art of optics and more particularly to optical lenses.

The invention is particularly applicable to a lens blank processing method and apparatus for eyeglass lenses and will be described with particular reference thereto. However, it will be appreciated by those skilled in the art that the invention has broader applications and may be adapted for practical use in processing other types of optical lenses employed in various environments.

In processing lens blanks into finished optical lenses for eyeglasses, many types of processing methods and apparatus have heretofore been employed. To some extent, the exact method steps and types of apparatus utilized have been dictated by the specifics of the lens generating, polishing and edging equipment utilized. Most processing methods have, however, required measuring of the lens blank for purposes of locating a desired optical center axis as prescribed by the lens prescription for allowing subsequent mounting of a lens block to the blank at that axis. The lens block facilitates convenient lens blank mounting in lens surface generating apparatus in order that the concave lens blank surface may be ground to a desired prescription. Following generation, the lens blank is fined and polished and then edged in separate processing apparatus. Typically, in order to achieve the final lens characteristics suitable for eyeglass use, it has been necessary to deblock and reblock the lens blank at least once during the fining and polishing and edging operations in order that the blank may be properly positioned relative to the processing apparatus involved. In addition, standard lens blocks often have diameters greater than the edged size of the lens. Such a dimensional relationship necessitates reblocking of lens blanks for edging purposes.

Heretofore, there have been quite a number of types and styles of lens blocks or lens blocking means for accommodating lens blank mounting in particular processing apparatus. These prior lens blocking arrangements are somewhat complex and do not effectively eliminate the necessity for lens blank layout prior to lens block mounting. Some of these prior lens blocking structures have essentially been comprised of two lens block components wherein one component is utilized in mounting the lens blank for some processing operations and the other component is utilized for mounting the lens blank in other processing operations. Usually, the first of these components must be removed from its blocked position on the lens blank prior to using the second component for subsequent processing operations. Moreover, some prior lens block arrangements have been configured so as to cover substantially the entire lens blank surface to which they are affixed. Thus, during lens blank edging, the lens block is itself partially consumed and is not reusable for processing additional lens blanks.

More particularly, one type of commonly used process for generating optical lenses from lens blanks entails mounting a lens block to the convex surface of the lens blank by means of a molten alloy so that the longitudinal axis of the lens block is substantially coaxial with the desired optical center axis of the lens blank. In such mounting, it is necessary to first lay out the lens blank by special layout apparatus to physically locate the optical center axis and any necessary rotation of the lens blank base line commensurate with the lens prescription. Thereafter, the lens block is mounted to the lens blank by the molten alloy with the block located on the convex lens blank surface at the optical center axis. At such mounting, the lens block is also rotated for accommodating any axis characteristics which are to be imparted to the lens in accordance with the prescription. The lens blank and lens block are then mounted in the lens surface generating apparatus which grinds the concave lens blank surface to prescription. When it is desired to impart prism characteristics to the lens blank, the lens block is often shimmed in the lens surface generating apparatus to angularly offset the lens blank optical center axis from its normal position.

Following surface generation, the lens blank and associated lens block are mounted in fining and polishing apparatus in order that the ground surface may be polished to the requisite optical quality. Thereafter, the partially completed lens blank is deblocked from the lens block and laid out a second time for properly locating a lens block which will accommodate edging apparatus. The lens blank is then reblocked, installed in edging apparatus and the lens blank edge ground to secure the final peripheral edge configuration. Following edging, the final lens is deblocked for any final processing steps and ultimately installation into the eyeglass frame.

The above described commonly used processing arrangement requires a substantial amount of hand labor and time for achieving lens blank layout and blocking. This labor and time is increased due to the fact that two separate layout and blocking steps are employed during processing of each lens. In addition, the fact that both the initial lens blank and partially processed lens blank require layout necessitate provision of special layout tools and operator skill. These factors, as well as others noted hereinabove, necessarily add to the cost and overall production time required for each lens.

It has, therefore, been desired to develop means whereby the various problems encountered in prior processing methods and apparatus could be overcome in order to increase the overall efficiency and reliability of lens production. The subject invention contemplates new and improved method and apparatus which meet these needs and provides a lens processing method and apparatus which are simple, require only a single blocking of the lens blank during the entire processing thereof into a finished lens, economical to use, which are useful in generating substantially all types of single and multivision lens prescriptions and which are adaptable to application in other environments.

BRIEF DESCRIPTION OF THE INVENTION

In accordance with the present invention, there is provided a lens block chuck assembly which facilitates desired positioning of a lens blank fixedly secured to a lens block or other lens blank retaining means relative to lens surface generating apparatus. The chuck assembly includes a chuck body having a first inner end and a second outer end spaced apart from each other with the chuck assembly longitudinal axis extending therebetween. A mounting member extends outwardly from the chuck body first end and is adapted to be fixedly received by the lens surface generating apparatus itself. This mounting member is operably associated with the chuck body in a manner allowing selective relative rotation therebetween so that the body may be selectively rotatably adjusted about the chuck assembly longitudinal axis to accommodate any axis requirements for a particular prescription. A clamp assembly is disposed in the body adjacent the second end and is adapted to selectively fixedly receive the lens blank retaining means in a manner such that the frame center axis of the associated lens blank is substantially coaxial with the chuck assembly longitudinal axis. The clamp assembly is selectively movable between an opened condition allowing the lens blank retaining means to be inserted into and removed from association with the chuck assembly and a closed condition clampingly engaging the lens blank retaining means. In addition, the clamp assembly is mounted in the chuck body in a manner which allows selective transverse movement thereof relative to the chuck assembly longitudinal axis. This feature permits the lens blank to be moved relative to the chuck assembly so that a desired optical center axis for the lens blank may be adjusted to a position substantially coaxial with the chuck assembly longitudinal axis. Through this arrangement, a predetermined prescribed amount of lens decentration is obtained during lens blank processing.

According to another aspect of the invention, separate lens blank support means is disposed adjacent the body second end to provide support for the lens block during processing. In addition, at least this support means is selectively movable between a first normal position adjacent the body second end and a second position spaced axially inward toward the body first end. This movement accommodates the requisite lens blank support and also compensates for lens blank curvature.

According to still another aspect of the invention, the chuck assembly includes means for permitting predetermined selected canting of the lens blank optical center axis relative to the chuck assembly longitudinal axis. This canting facilitates a predetermined amount of prism to be imparted to the lens blank during processing in order to obtain desired optical characteristics therein.

According to a further aspect of the invention, first adjustment means are provided to effect transverse movement of the clamp assembly in the housing. Further, second adjustment means are provided for selectively incrementally rotating the chuck body relative to the mounting member between a first home or normal position and a second rotated position. This rotational adjustment allows a predetermined prescribed amount of axis to be incorporated into the lens blank during surface generation.

In accordance with an additional aspect of the invention, a special adapter chuck is employed in conjunction with lens surface fining and polishing apparatus utilized subsequent to the surface generating apparatus. This adapter chuck is required in at least those instances where the chuck body has been rotated relative to the mounting member from the first normal position to a second rotated position to obtain lens blank axis during surface generation thereof. The adapter chuck receives the lens block and allows rotation thereof so that the generated cylinder axis of the lens blank may be positioned in general parallel alignment with the lap base curve of the fining and polishing apparatus.

In accordance with another aspect of the present invention, there is provided a method for generating an optical prescription into a lens blank surface which only requires a single mounting of the lens blank to an associated lens block. This method comprises the steps of:

(a) affixing the associated lens block to the lens blank so as to extend outwardly from the face thereof which is opposite to the lens blank face which is to be processed;

(b) placing the lens block in operative communication with a chuck operably communicating with the tailstock of lens generating apparatus such that the frame center axis of the lens blank is substantially coaxial with the longitudinal axis of the tailstock;

(c) adjusting the position of the lens blank in the chuck such that a desired optical center axis for the lens is substantially coaxial with the tailstock longitudinal axis; and, (d) generating the desired optical surface of the lens blank processed face and thereafter removing the lens block and lens blank from association with the chuck.

According to yet another aspect of the invention, the method includes between the steps of placing and generating the step of rotating the lens blank substantially about the tailstock longitudinal axis a predetermined arcuate distance from a first normal position to a second position in order to obtain predetermined desired optical characteristics in the lens blank during the step of generating.

According to still a further aspect of the invention, the method includes prior to the step of generating the step of canting the lens blank such that the optical center axis thereof is canted a predetermined amount relative to the longitudinal axis of the tailstock for imparting a desired amount of prism to the lens blank during the step of generating.

Additional steps employed to finalize the lens subsequent to the step of generating include mounting the lens block and lens blank in polishing apparatus such that the lens blank frame center axis is substantially coaxial with the longitudinal axis of a polishing apparatus chuck; polishing the processed face of the lens blank; positioning the lens block and lens blank in edging apparatus such that the lens blank frame center axis is substantially coaxial with the longitudinal axis of an edging apparatus chuck; edging the lens blank to have a predetermined desired peripheral edge configuration; and, thereafter deblocking the lens block from the finished lens.

In practicing the method in conjunction with plastic lens blanks which could distort when subjected to elevated temperatures, the method further includes during the step of affixing the step of interposing a heat shield between the lens blank opposite face and the lens block.

In accordance with another aspect of the present invention, there is provided a lens block construction adapted to be fixedly secured to the convex face of an unfinished lens blank to facilitate chucking retention of the lens blank during processing thereof into an optical lens having predetermined optical characteristics. This lens block includes a generally circular mounting face and a mounting member extending generally normal to the mounting face from the rear area thereof. The mounting face itself has a diameter substantially less than the cross-sectional dimension of the lens blank. While the mounting face of the preferred arrangement has a spherically radiused concave configuration generally compatible with the convex lens blank face, a mounting face having a generally flat configuration may also be satisfactorily utilized. The mounting face further includes at least one groove-like area extending thereinto which is adapted to receive a portion of an adhesive material interposed between the mounting face and the convex lens blank face for fixedly securing the two together. The mounting member has a mounting portion adapted to be selectively fixedly mounted to a chuck operably associated with lens generating apparatus and further has means for precisely locating the lens block relative to the chuck.

The principal object of the invention is the provision of a new and improved adapter chuck for mounting lens blanks.

It is another object of the invention to provide such a chuck which enables very rapid mounting and demounting of a lens block, and also allows relative rotation between the adapter chuck body and the seat block which holds the lens block.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein:

FIG. 15 is a partial plan view in the direction of lines 15—15 of FIG. 9;

FIG. 16 shows a rotate position indicator for use with typical lens surface generating apparatus;

FIG. 17 is a partial cross-sectional view of the clamp assembly showing the lens blank and lens block in a clamped position therein;

FIG. 18 is a partial cross-section of a plan view showing mounting of the lens blank to impart a desired prism angle thereto;

FIG. 19 is an end view of the chuck assembly showing the lens blank in a clamped position with the structure of the clamp assembly in phantom for ease of illustration; and, FIG. 20 is an exploded perspective view of an adapter chuck used in conjunction with fining and polishing so-called cylindrical lenses;

DESCRIPTION OF THE PREFERRED EMBODIMENT

Figure 1:
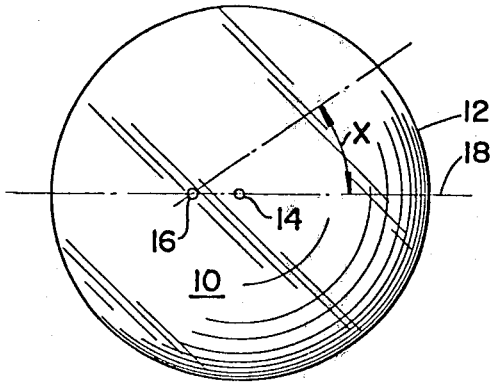
FIG. 1 is a plan view of a typical lens blank as viewed in the direction of the convex surface thereof.

Referring now to the drawings wherein the showings are for purposes of illustrating the preferred embodiment of the invention only and not for purposes of limiting same, the FIGURES show a lens block arrangement (FIGS. 3–5) and a lens block chuck assembly (FIGS. 8–15). The chuck assembly is comprised of a chuck body A having mounting means B disposed at one end thereof and lens block receiving assembly C disposed at the other end thereof.

More particularly, and with regard to FIGS. 1–7, the concepts of the subject invention are particularly applicable to processing so-called eyeglass lens blanks of a type shown in FIG. 1 and generally designated 10. The blank has a convex outer face shown in the view of FIG. 1 and a concave inner face. The inner face is the one which is to be ground in lens generating apparatus in order that the finished lens will have the desired optical characteristics. The lens blank shown is for a single vision lens, although the concepts of the subject invention are equally applicable to processing multivision lens blanks. Blank 10 includes a circular outer peripheral edge 12 with a frame center or mechanical axis 14 disposed at the midpoint thereof and extending normal to the drawing. Spaced from and substantially parallel to frame center axis 14 is a desired optical center axis 16. Both axes 14,16 are located on an imaginary line 18 extending laterally across the lens blank. This imaginary line is commonly referred to as the base line. The relative positioning between axes 14,16 is dependent upon the patient's pupilary distance as determined by the specific lens prescription and the eyeglass frame to be used. The distance between axes 14,16 is generally termed in the art as decentration. Angle x represents a so-called axis angle for the finished lens in accordance with the lens presciption and is required for so-called cylindrical lenses used to correct for various types of astigmatisms.

Figure 2:
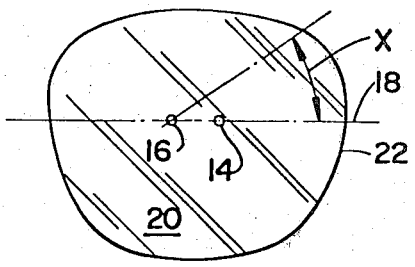
FIG. 2 is a view similar to FIG. 1 showing the lens blank after it has been processed into a finished lens.

FIG. 2 generally shows a finished lens from the convex face thereof and which lens has been ground and edged from the lens blank of FIG. 1. The finished lens includes a lens body 20 having an outer peripheral edge 22 of a configuration commensurate with the desired frame size and style. Depending upon the desired final size and peripheral configuration for lens 20, frame center axis 14 may be somewhat offset from the center of the finished lens. Lens blank 10 and finished 20 are typically constructed from glass or plastic as is known in the lens art and the invention of the subject application is deemed applicable to these various materials.

Figure 4:
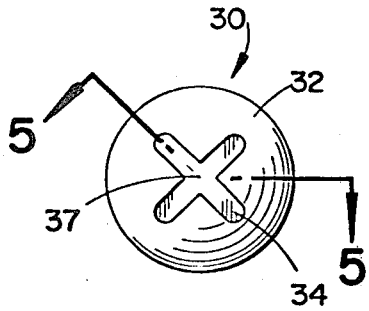
FIG. 4 is a bottom view of the lens mounting surface of the lens block of FIG. 3.
Figure 3:
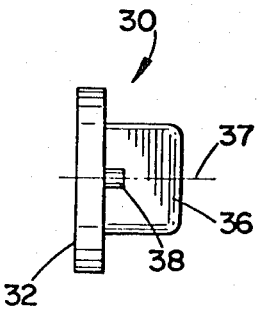
FIG. 3 is a side elevational view of the lens block used in accordance with the subject invention.
Figure 5:
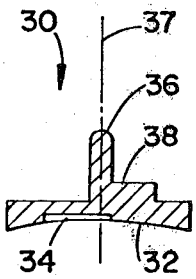
FIG. 5 is a cross-sectional view taken along lines 5—5 of FIG. 4.

FIGS. 3, 4 and 5 show a non-consumable lens block arrangement used in locating and mounting the lens blank to the chuck assembly. The lens block itself is generally designated 30 and includes a generally circular mounting face area 32 dimensioned to have a diameter substantially less than the diameter of lens blank 10. In addition, the mounting face has an inward spherical radius so as to be substantially compatible with the convex surface of lens blank 10. However, it is also possible to have the mounting face configured to be generally flat for use in processing lenses as well as for use in other processing applications and environments. A generally X-shaped groove 34 is generally centrally disposed in mounting face 32 to receive a portion of an adhesive material utilized to fixedly mount the lens block to the lens blank in a manner which will hereinafter be described. A mounting tab 36 extends outwardly of block 30 opposite from mounting face 32 and generally normal thereof at least partially diametrically thereacross. Lens block longitudinal axis 37 extends through mounting face area 32 and mounting tab 36 as shown. A locating protrusion 38 extends generally normally outward from both mounting tab 36 and the surface of block 30 opposite from mounting face 32. As will be noted from both FIGS. 3 and 5, protrusion 38 does not extend as far outwardly from block 30 as does mounting tab 36. Although a number of materials could be advantageously employed, lens block 30 is preferably cast from aluminum or an aluminum alloy.

Figure 6:
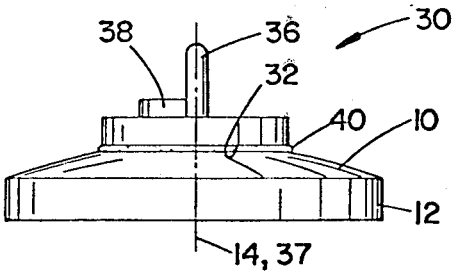
FIG. 6 is a side elevational view of the lens blank of FIG. 1 with the lens block affixed thereto.
Figure 7:
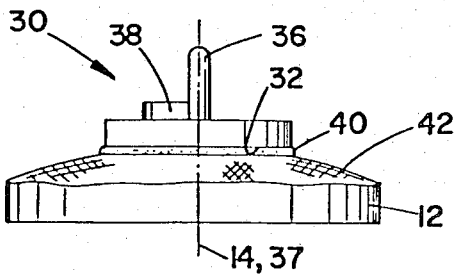
FIG. 7 is a view similar to FIG. 6 but with a heat shield interposed between the lens block and lens blank convex surface.

FIGS. 6 and 7 show lens block 30 as it has been fixedly mounted to lens blank 10. As shown in FIG. 6, an adhesive material 40 is interposed between the convex face of lens blank 10 and concave mounting face 32 of the lens block. In the preferred arrangement, adhesive 40 comprises a polyester base hot melt material such as that marketed by the Bostik Division of USM Corp. under the grade designation 9376. Other types of hot melts or adhesive materials may also be advantageously employed without departing from the overall intent or scope of the invention. The hot melt or other adhesive may be applied by convenient means such as by hand or automatic applicating equipment. The specifics of such means or equipment does not form a part of the present invention and is not described in detail herein. For a single vision type lens for which operation of the subject invention will be described, lens block 30 is mounted coaxial with lens blank frame center 14. The arrangement of FIG. 6 is particularly used with glass lens blanks and has been found to facilitate sufficient strength to rigidly retain the lens block on the lens blank during subsequent lens processing operations.

For plastic lens blanks which may be subject to undesired heat distortion caused by the introduction of a hot melt adhesive thereagainst, the arrangement of FIG. 7 is advantageously employed. Some hot melts which could be satisfactorily used in practicing the concepts of the subject invention may have melting temperatures as high as 600° F. and some plastic lens blanks can be adversely distorted when subjected to such temperatures. To prevent the possibility of such distortion, the arrangement of FIG. 7 employs a heat shield 42 interposed between adhesive 40 and the convex surface of the lens blank. The heat shield is dimensioned to at least substantially cover the entirety of the convex face. Within the scope of the subject invention as described and claimed hereinafter, the lens block is deemed to be affixed to the lens blank even though a heat shield is interposed therebetween. The heat shield itself may comprise any of a number of materials which have aggressive adhesion to the lens blank material. Conventional duct tape has been found to provide satisfactory results and preformed or precut heat shields may be conveniently formed from such material. In both FIGS. 6 and 7, adhesive material is received in X-shaped groove 34 of the lens block for enhancing the rigidity of the connection between the block and lens blank.

Also as shown in FIGS. 6 and 7 and with secondary reference to the single vision type lens blank of FIG. 1, lens block 30 is mounted coaxial with frame center axis 14 and with mounting tab 36 substantially parallel to lens blank base line 18. In addition, locating protrusion 38 is disposed to extend toward the lens blank bottom as it is viewed in FIG. 1. This mounting assures proper lens blank location in the chucking assembly as will be hereinafter described in detail. While the aforementioned mounting of the lens block to the lens blank is for a single vision lens, the concepts involved are equally applicable to a multivision lens. In the case of a multivision lens blank, it is necessary to utilize conventional layout techniques in order to ascertain the lens blank frame center axis. However, since such means are known and do not form a part of the present invention, they are not described in greater detail herein. It should be noted that in the case of the multivision lens, location of the frame center must also take into account the location and drop of the lens blank segment. Once the frame center for a multivision lens blank has been located, the lens block is mounted substantially coaxial therewith as in the above described single vision lens blank.

Figure 8:
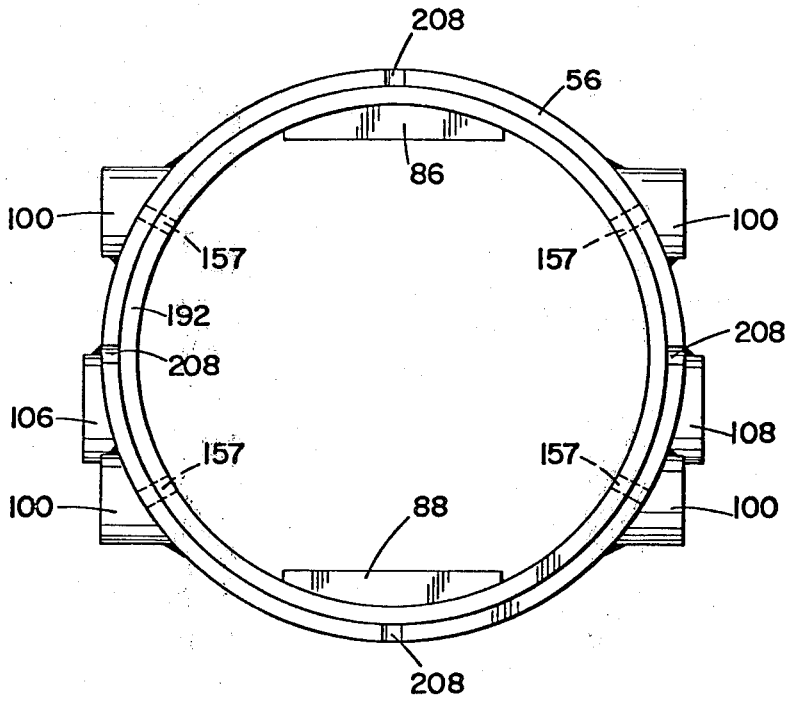
FIG. 8 is an end view of the lens chuck assembly body with the remaining portion of the assembly removed therefrom for ease of illustration.
Figure 9:
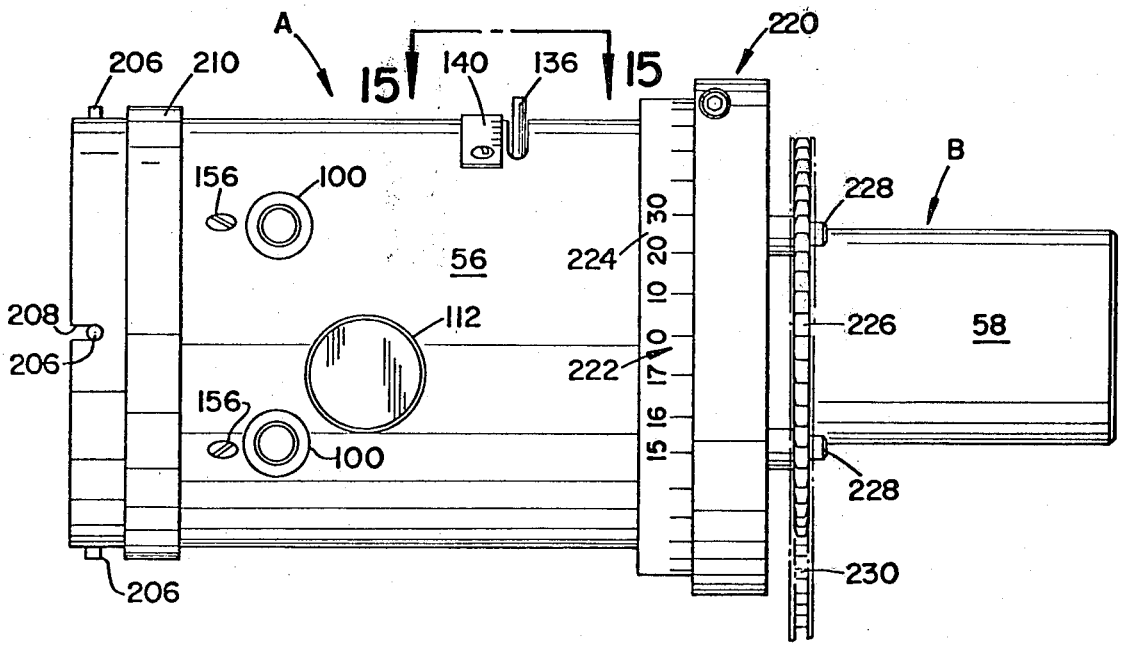
FIG. 9 is a side elevational view of the lens chuck assembly.
Figures 10, 13, 14:
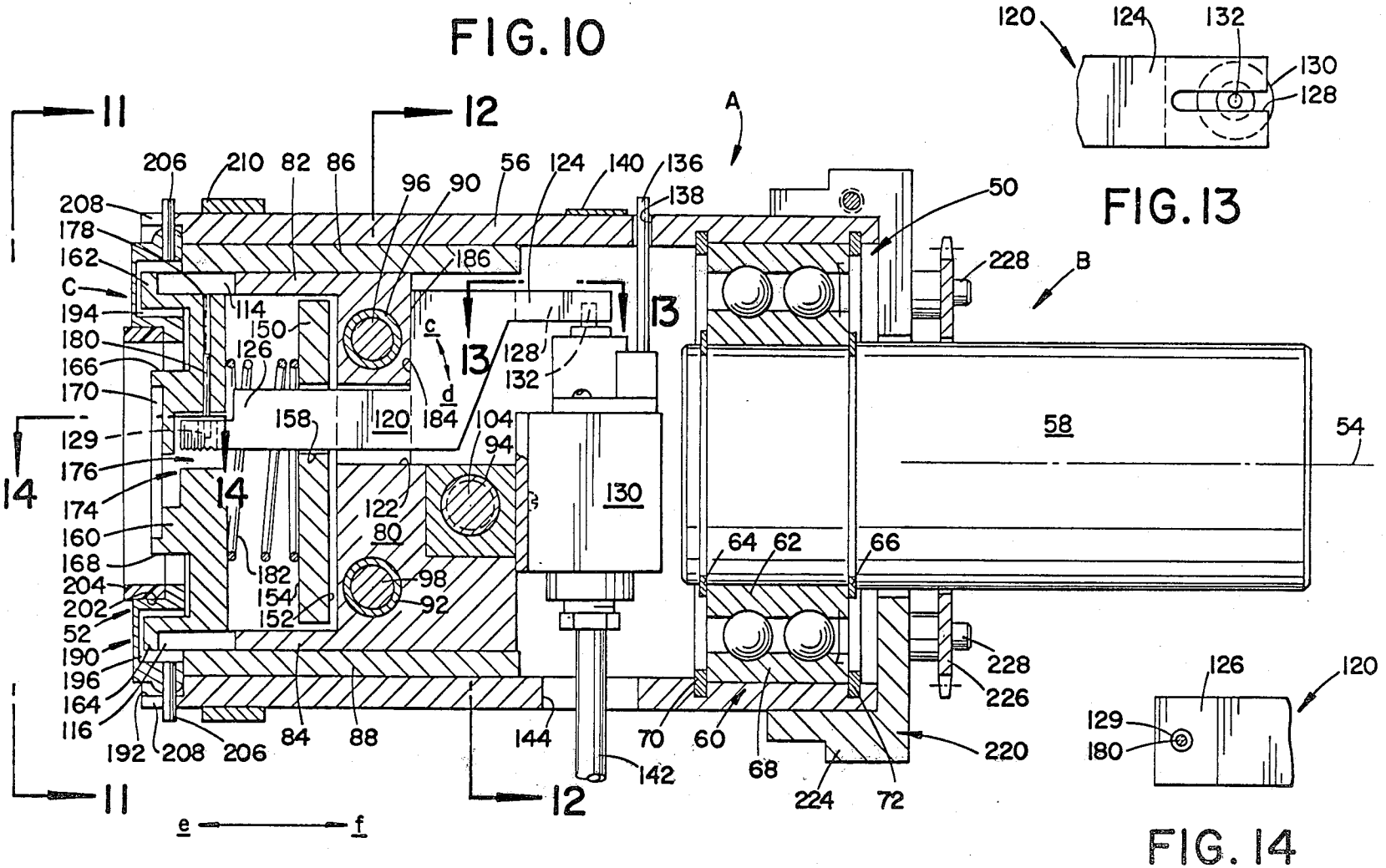
FIG. 10 is a longitudinal cross-sectional view of the chuck assembly of FIG. 9.
FIG. 13 is a partial plan view in the direction of lines 13—13 of FIG. 10.
FIG. 14 is a partial plan view in the direction of lines 14—14 of FIG. 10.

FIGS. 8–15 variously show the chuck assembly which forms a part of the present invention. With particular reference to FIG. 10, chuck assembly A has a first or inner end 50, a second or outer end 52 and a longitudinal axis 54 extending between the two ends. The chuck body is defined by an elongated, generally cylindrical open ended housing 56. Mounting means B comprises an elongated solid shaft 58 rotatably mounted at inner end 50 coaxial with axis 54 by means of a roller bearing assembly generally designated 60. This bearing assembly includes an inner race 62 communicating with shaft 58 and retained in position by means of conventional spaced apart retaining rings 64,66. An outer race 68 communicates with the inner side wall of housing 56 and is retained in position thereon by spaced apart conventional retaining rings 70,72. The interconnection between housing 56 and shaft 58 is such that the housing may be freely rotated about axis 54 when shaft 58 is fixedly received in the tailstock of lens generating apparatus as will be further described hereinafter.

Figure 11:
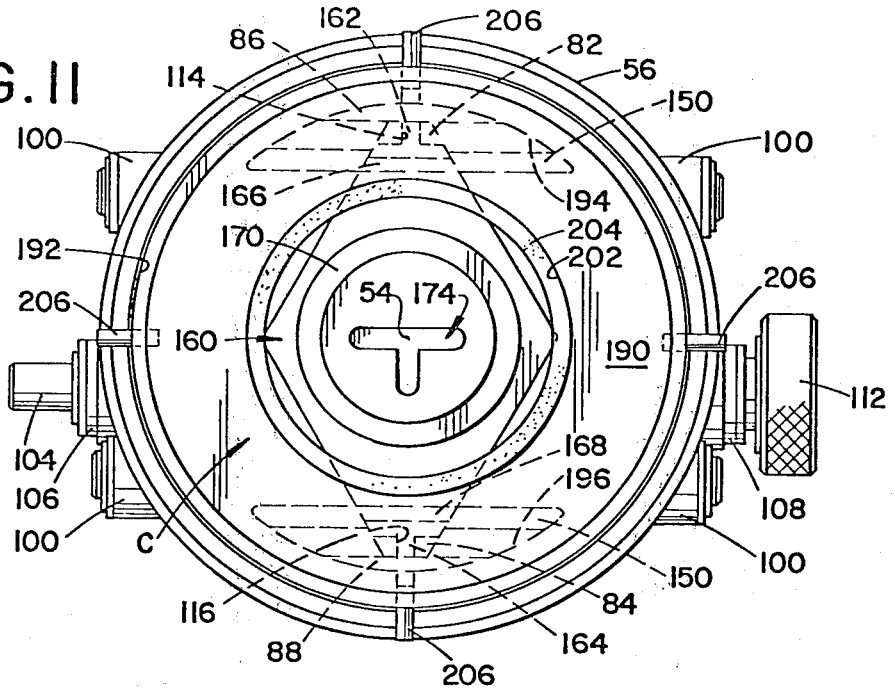
FIG. 11 is an end view in the direction of lines 11—11 of FIG. 10.
Figure 12:
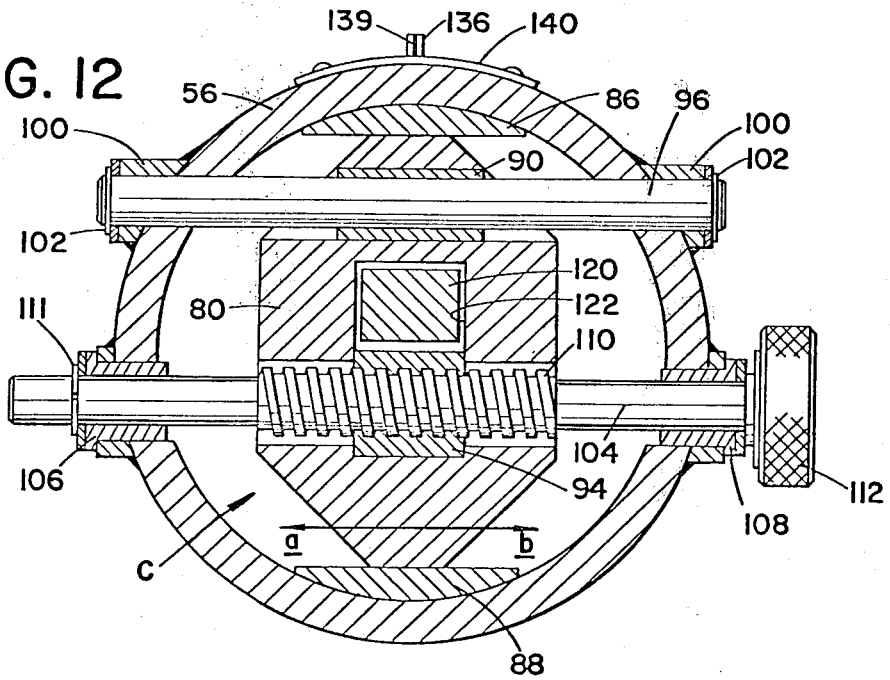
FIG. 12 is a cross-sectional view taken along lines 12—12 of FIG. 10.

Referring particularly to FIGS. 8–12, receiving means C includes a block carriage body generally designated 80 received in housing 56 and includes a pair of parallel spaced apart legs 82,84. These legs extend axially of housing 56 and are slidably received against spacers 86,88 which themselves extend axially of the housing and are fixedly secured thereto diametrically thereacross (FIGS. 8, 10 and 11). Spacers 86,88 provide support surfaces for legs 82,84 in order to allow selective transverse movement of carriage body 80 relative to housing 56 in a manner to be described. A pair of through openings 90,92 which include support shaft bushings extend through body 80 generally transversely of housing 56 as is best shown in FIGS. 10 and 12. A through opening generally designated 94 which includes an internally threaded bushing similarly passes transversely through body 80 as is also best shown in FIGS. 10 and 12. Preferably, the threads on this bushing are of the Acme type to facilitate close transverse adjustment of body 80 relative to housing 56. As shown in FIGS. 8–12, elongated mounting and support shafts 96,98 are received through openings 90,92, respectively, through the side wall of housing 56 and are supported adjacent each end thereof by locating bosses 100. These mounting and support shafts are retained in position by means of retaining rings 102 received thereon and acting against the outer face of the associated locating boss. An elongated adjustment screw has the ends thereof extending through housing 56 and supported by bushings 106,108. This adjustment screw includes a generally centrally located externally threaded area 110 of the Acme type threadedly engaged with the threads of the bushing in carriage body opening 94. One end of the adjustment shaft is retained in position by means of a conventional retaining ring 111 acting against bushing 106 and the other end includes an adjustment knob 112.

By rotating knob 112 in one direction or the other, block carriage body 80 may be moved transversely of body 56 in directions a and b as shown in FIG. 12 to efect lens blank decentration as will hereinafter be described. While knob 112 requires manual adjustment, it should also be readily appreciated that the knob may be removed and replaced by means for automatically or mechanically imparting rotation to shaft 104 in order to obtain the desired decentration adjustment. Mounting and support shafts 96,98 provide rigid support for block carriage body 80 and allow it to slide in either direction therealong in response to movement of the adjustment shaft. As best seen in FIG. 10, carriage body legs 82,84 extend axially outward from body 80 itself and terminate at a position adjacent housing outer end 52. These legs also include inwardly extending seating block receiving grooves 114,116, respectively, for purposes of receiving a seating block component as will be described.

Referring to FIGS. 10 and 12–14, a clamp arm generally designated 120 is associated with block carriage body 80. This clamp arm extends through an opening 122 in carriage body 80 and has a rear activating end 124 and a forward clamp end 126. An elongated slot 128 is included in activating end 124 and a circular through opening 129 is included in clamp end 126. The clamp end may also advantageously include a plurality of serrations or teeth for enhancing its gripping relationship with a lens block as will become more readily apparent hereinafter. A drive or activating cylinder generally designated 130 is fixedly secured to the rear of carriage body 80 and has a piston rod end 132 extending upwardly thereof into slot 128. The function of slot 128 and opening 129 will become apparent hereinafter. A position pointer 136 is mounted to drive cylinder 130 so as to extend upwardly therefrom and outwardly through the transverse slot 138 in housing 56 (FIGS. 10 and 15). Position pointer 136 includes position indicating indicia 139 (FIGS. 12 and 15) and a position indicating scale 140 (FIGS. 12 and 15) extends transversely of housing 56 adjacent one leg of slot 138. While scale 140 may be calibrated in any desired manner designating distance, the scale is typically calibrated in the metric system. Position pointer 136 with indicating indicia 139 are positioned such that when indicia 139 is directly across from the zero designation on scale 140, block carriage body 80 is precisely centered within housing 56. As adjustment knob 112 is rotated in one direction or the other for moving carriage body 80 transversely of housing 56 in one of directions a and b, pointer 136 will similarly be moved in slot 138 relative to scale 140. In this manner, the decentration distance for a particular lens blank may be selectively adjusted as may be required pursuant to the lens prescription. A fluid pressure supply line 142 passes through the side wall of housing 56 at opening 144 with one end thereof connected to a source (not shown) of fluid pressure and the other end operably connected to drive cylinder 130. Convenient means (not shown) are also provided for selectively energizing and deenergizing the drive cylinder.

As drive cylinder 130 is energized, rod end 132 is moved from the retracted position shown in FIG. 10 to an extended position and thereby forces rear activating end 124 of clamp arm 120 upwardly from the position shown. This, in turn, acts to pivot the clamp arm in order that forward clamp end 126 will be brought into clamping engagement with the lens block in a manner which will become apparent hereinafter. Retraction of rod end 132 then allows clamp arm 120 to be moved back to its initial position. The directions of movement of clamp arm 120 in response to energization and deenergization of drive cylinder 130 are generally designated by arrows c and d in FIG. 10.

With continued reference to FIG. 10, and with secondary reference to FIG. 11, a pivot disc generally designated 150 having a rear face 152 and a front face 154 is fixedly positioned in housing 56 forwardly adjacent carriage body 80. A plurality of threaded fasteners generally designated 156 (FIG. 9) pass through circumferentially spaced apart openings 157 (FIG. 8) in housing 56 and into threaded communication with the peripheral side wall of pivot disc 150. Thus, the pivot disc is stationary relative to housing 56. A generally centrally disposed opening 158 extending between rear face 152 and front face 154 (FIG. 10) allows free floating passage of clamp arm 120 through the pivot disc.

Another portion of receiving means C comprises a seating block or plate generally designated 160 in FIGS. 10 and 11. This seating plate generally has the peripheral configuration of a parallelogram with a pair of opposed, outwardly extending tabs 162,164 disposed at the acute apex areas thereof. Tabs 162,164 are dimensioned to be closely slidably received in seating block receiving grooves 114,116 of carriage body legs 82,84, respectively. For reasons which will become apparent, some axial movement of seating plate 160 relative to carriage body legs 82,84 is permitted and the extent of such movement is determined by the length of receiving grooves 114,116 themselves. The seating plate further includes a pair of parallel spaced apart grooves 166,168 for receiving a lens support plate to be described. In addition, a generally circular, inwardly extending recess 170 is included centrally of plate 160 and includes a generally T-shaped receiving opening 174 which substantially corresponds to the overall T-shaped configuration of mounting tab 36 and locating protrusion 38 of lens block 30 previously described with reference to FIGS. 3–5. A rear opening generally designated 176 allows forward clamp end 126 of the clamp arm to penetrate seating plate 160 and communicate with receiving opening 174 for selective clamping engagement with a lens block 30.

As shown in FIG. 10, an elongated through bore 178 extends from the outer periphery of the seating plate into communication with rear opening 176 and receives an elongated retaining pin 180. This retaining pin extends outwardly of through bore 178 at the area of rear opening 176 into opening 129 in forward clamp end 126 of the clamp arm (FIG. 14). A compression type spring biasing means 182 is interposed between pivot disc front face 154 and the rear face of seating plate 160. The pivot disc is, of course, fixedly secured to housing 56 and spring biasing means 182 is dimensioned so that it will continuously urge seating plate 160 axially of housing 56 toward second or outer end 52. The axially outermost position of seating plate 160 is considered to be the first or normal position for that plate 160. Since seating plate and clamp arm 120 are loosely connected as at retaining pin 180, seating plate 160 will be urged axially outward by spring biasing means 182 until knee area 184 of the clamp arm engages the rear area 186 of carriage body 80 as shown in FIG. 10. Some axial inward movement of seating plate 160 against the force of spring biasing means 182 is permitted due to the fact that seating plate tabs 162,164 are slidably received in receiving grooves 114,116, respectively, of carriage body legs 82,84. Since the seating plate and clamp arm are interconnected as at retaining pin 180, the clamp arm itself will also be moved axially inward from the position shown in FIG. 10 along with seating plate 160. Elongated slot 128 included in rear actuating end 124 of the clamp arm allows such movement and prevents the actuating end from interfering with reciprocation of drive cylinder rod end 132 during extension and retraction thereof. The limited axial movement of seating plate 160 is important for allowing lens blanks having different convex surface radii of curvature to be properly seated in the clamp assembly. This feature will be described in greater detail hereinafter with the directions of such seating plate axial movement being designated e and f in FIG. 10.

Also comprising a part of receiving means C is a lens blank support plate generally designated 190 in FIGS. 10 and 11. This support plate has a generally annular configuration and is received within a circumferentially extending groove 192 included at housing second or outer end 52. Support plate 190 includes a pair of spaced apart elongated relief areas 194,196 extending inwardly into the support plate from the rear face thereof. These relief areas receive the outermost ends of block carriage body legs 82,84 and seating block or plate tabs 162,164 to facilitate selective transverse movement thereof relative to both support plate 190 and chuck body 56. A circular groove 202 at the inside diameter of annular support plate 190 receives an annular lens blank support ring 204. Ring 204 extends slightly outwardly from the front face of plate 190 and may be fixedly secured in groove 202 by convenient means such as, for example, a press fit arrangement, adhesives, spring pins or various combinations thereof. The support ring is advantageously constructed from polytetrafluoroethylene, nylon or a phenolic fiber material. Other materials could also be advantageously employed although it is preferred that the ring be constructed from material which is not extremely resilient. Support ring 204 acts to support the lens blank convex surface radially outward of lens block mounting face 32 during the lens surface generating operation. Four equidistantly spaced apart pins 206 extend radially outward from the periphery of lens support plate 190 and are received in axially inward extending slots 208 in housing 56 at second or outer end 52 thereof. This arrangement is best shown in FIGS. 9 and 10 with lens support plate 190 being positively retained at a home position by physical engagement of each pin 206 with the innermost end wall of the associated slot 208 and by physical engagement between support plate 190 and the innermost end wall of circumferential groove 192. A prism spacer 210 extends circumferentially around the outside of housing 56 adjacent end 52. This prism spacer is fixedly secured to the housing by convenient means such as a mounting pin 212 (FIGS. 17 and 18) which penetrates the side wall of housing 56. This prism spacer is utilized for locating a prism ring on the housing as will be described in some greater detail hereinafter.

As previously noted, chuck body A and mounting means B are interconnected with one another so that there is free relative rotation therebetween about longitudinal axis 54. For purposes of controlling the amount or degree of such rotation, a cup-like rotate gear mounting bracket 220 is fixedly disposed over first or inner end 50 of housing 56. This bracket includes a degree scale generally designated 222 disposed to extend over a circumferential portion of bracket side wall 224. The scale itself is for purposes of indicating the relative rotated relationship between chuck body A and mounting means B in either direction from a normal or zero setting to accommodate imparting axis to the lens blank during surface generation in accordance with the lens prescription. A drive gear generally designated 226 is received over shaft 58 and fixedly secured to bracket 220 by convenient means such as threaded fasteners or the like generally designated 228. A drive chain 230 (FIG. 9) is entrained about gear 226 and extends to a drive arrangement (not shown) for purposes of allowing selective rotational adjustment of chuck body A.

FIG. 16 shows an axis position pointer generally designated 240 having an elongated mounting slot 242, a pointer end 246 and indicator indicia 248. The pointer is adapted to be conveniently fixedly secured to the lens surface generating apparatus itself as at mounting slot 242 with pointer end 246 disposed closely adjacent scale 222. The chuck assembly itself is mounted to the lens surface generating apparatus with mounting means B fixedly secured in and coaxial with the apparatus tailstock. The chuck assembly herein described has been designed for particular use in lens surface generating apparatus marketed by Coburn Optical Industries, Inc. The pointer is positioned so that when indicator indicia 248 is aligned with the zero position of scale 222, the relative positioning between chuck body A and mounting means B is such that no axis will be ground into the lens blank surface during surface generation. If a prescription requires axis, it is simply necessary to activate the drive arrangement associated with chain 230 to allow selective rotation of chuck body A relative to mounting means B so that the desired axis angle corresponds with indicator indicia 248 on the pointer. Thereafter, the drive arrangement is simply locked to retain the chuck body in position.

FIGS. 17 and 19 show a lens block 30 with a lens blank 10 adhesively affixed thereto as described with reference to FIG. 6 as they have been mounted in the chuck assembly in preparation for a lens surface generating operation on the lens blank concave surface. As will be noted from FIG. 17, the circular body of lens block 30 is closely received by seating plate circular recess 170 with lens block mounting tab 36 and locating protrusion 38 closely received in T-shaped receiving opening 174. In addition, mounting tab 36 extends into seating plate rear opening 176 beneath forward clamp end 126 of clamp arm 120. The lens blank is pushed axially inward of housing 56 until the convex surface thereof engages support ring 204 of lens support plate 190 which is fixedly positioned relative to body 56. Depending upon the curvature of the lens blank convex face, seating plate 160 may be forced axially inward slightly in direction f against the outward urging of spring biasing means 182. Seating plate tabs 162,164 guide the seating plate during this axial movement by their close cooperative sliding receipt in grooves 114,116 of carriage body legs 82,84. Once the convex face of the lens blank is seated against support ring 204, the drive cylinder is energized so that clamp arm 120 is moved to its clamping position with forward clamp end 126 closely retainingly engaging lens block mounting tab 36 in the manner shown in FIG. 17.

At the time of the aforesaid mounting of the lens block with lens blank in the clamp assembly, and with reference to FIG. 19, carriage body 80 has been adjusted by means of knob 112 so that it is centrally disposed in housing 56 with indicating indicia 139 of pointer 136 at the zero position of scale 140 (FIG. 15) and so that indicator indicia 248 of axis position pointer 240 is similarly at the zero position of scale 222 (FIG. 9). With these settings, lens block mounting tab 36 extends horizontally of housing 56 with lens block locating protrusion 38 extending downwardly thereof as hereinabove previously described. Depending upon the precise construction and operation of the particular surface generating apparatus employed, base line 18 may be oriented in other than a horizontal position when the chuck assembly is at the zero or normal position. However, in the Coburn type generating apparatus for which the subject chuck assembly has been used, base line 18 is located in the horizontal direction when the assembly is in the zero or normal position. Variations from this positioning do not in any way affect the scope of the subject invention and the particular relationships shown in the FIGURES are simply for ease of appreciating and understanding the invention. At the clamp assembly setting shown, frame center axis 14 of lens blank 10, longitudinal axis 54 of the chuck and the longitudinal axis of the lens surface generating apparatus are substantially coaxial with each other and the lens blank is ready for processing.

In the event lens decentration is required in accordance with the predetermined lens prescription, knob 112 for adjustment shaft 104 is rotated in the proper direction to move block carriage body 80 and seating plate 160 to achieve the desired decentration distance as reflected by movement of position pointer 136 relative to scale 140. The decentration adjustment shifts optical center axis 16 of lens blank 10 from the position shown in FIG. 19 to a position where it is substantially coaxial with chuck body longitudinal axis 54 and with the generating apparatus tailstock. Such transverse shifting is again designated by directions a and b in FIG. 19. If no axis adjustment is required by the prescription, the lens blank is ready for processing in lens generating apparatus.

However, in the event a so-called cylindrical lens is to be generated which requires axis, further adjustment of the chuck assembly is necessary. To achieve an axis angle setting specified by a lens prescription, it is merely necessary to activate the drive means (not shown) associated with the drive chain 230 (FIG. 9) to achieve rotation of chuck body A relative to mounting means B. This rotation is continued until the relationship between pointer 240 (FIG. 16) and scale 222 (FIG. 9) indicates the prescribed angle x show in FIG. 19. The directions of rotation for accommodating axis angles are generally designated g and h in this same FIGURE. With this adjustment, lens blank 30 is rotated about optical center axis 16 so that the desired axis angle falls on the original horizontal lens blank base line 18. Thereafter, the chain drive means is locked to prevent any further rotation during lens surface generation.

In the event it is desired to impart prism to the lens in accordance with a predetermined prescription, it is necessary to make a further adjustment of the lens blank relative to chuck body A. With the above discussed adjustments to accommodate decentration and/or axis, optical center axis 16 is disposed at least substantially coaxial with housing longitudinal axis 54 and the generating apparatus tailstock. To accommodate prism, however, it is necessary to slightly cant the optical center axis relative to these longitudinal axes. This canting is achieved by the separately affixable component shown in FIG. 18. More particularly, a plurality of prism rings are supplied with the chuck assembly to accommodate different degrees or amounts of prism as may be required.

One such prism ring is generally designated 260 in FIG. 18 and is dimensioned to closely encircle the outside periphery of housing 56 adjacent end 52 thereof. The innermost end face of this ring physically engages the outermost end of prism spacer 210 as shown in the FIG. 18 to insure precise positive location thereof. The prism ring is dimensioned such that it extends slightly axially outward of slots 208 in housing 56. In addition, four axial slots are provided at the outermost end of the ring at equidistantly spaced locations with three of these slots 262,264 and 266 being shown in FIG. 18. Although the prism ring slots and slots 208 of housing 56 are in radial alignment, the prism ring slots are disposed axially outward of slots 208 and are utilized to receive pins 206 of lens support plate 190 for prism adjustment.

The axial depths of the prism ring slots are not equal to ech other. As seen in FIG. 18, the depth of slot 266 is greater than the depth of slot 264 and the depth of slot 264 is greater than the depth of slot 262. In addition, the slot positioned diametrically opposite slot 264 (not shown) and slot 264 have the same depth. Thus, and in view of FIG. 18, slots 264 along with the opposite slot provide a pivot area vertically of the chuck assembly as it is viewed in FIG. 19. The depths of slots 262,266 then positively determine the particular canted orientation of lens support plate 190 relative to housing 56 at end 52. Typically, the depth of slot 264 along with the depth of the diametrically opposed slot for each size of prism ring is the same with only the depths of slots 262 and 266 being varied to adjust for specific prism requirements. Again, a plurality of prism rings 260 are provided and allow lens correction for so-called lazy eye condition.

The above three adjustment capabilities may be made independent of each other to facilitate lens generation pursuant to substantially all types of lens prescriptions. That is, the decentration, axis and prism adjustments may be independently incorporated into the chuck assembly.

Figure 20:
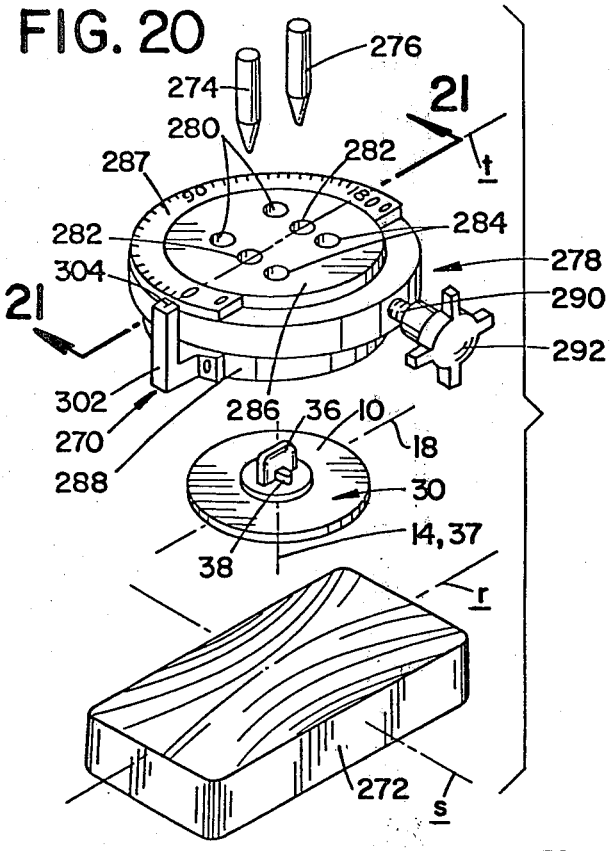
Figure 22:
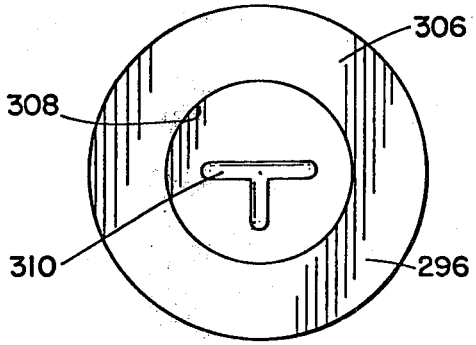
FIG. 22 is a bottom view of the adapter chuck showing the lens block receiving opening; and, FIG. 23 is a flow chart showing the method steps of the subject invention.
Figure 21:
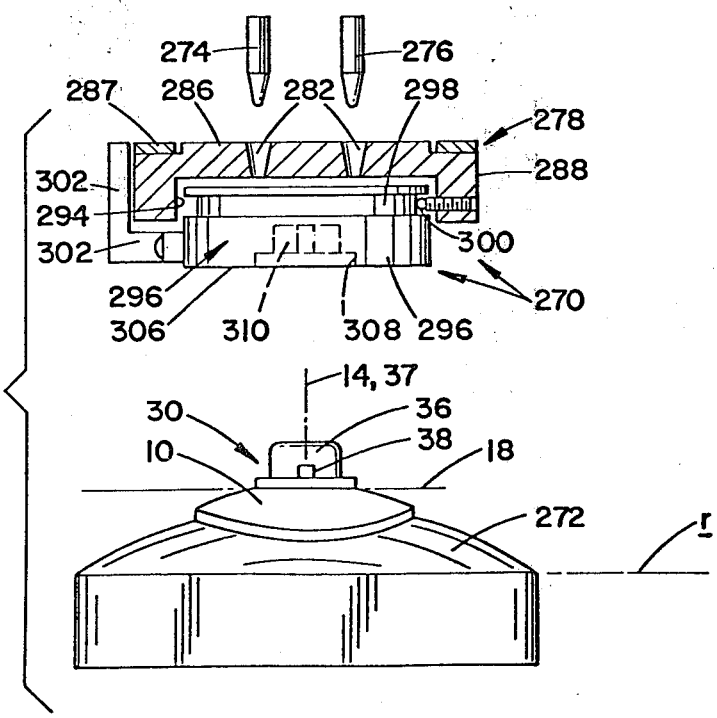
FIG. 21 is a cross-sectional view of the adapter chuck taken along lines 21—21 of FIG. 20.

FIGS. 20–22 show a special adapter chuck 270 employed with fining and polishing apparatus utilized subsequent to the lens blank surface generation. Use of this special adapter chuck is required in practicing the overall inventive concept of the subject development in conjunction with the manufacture of cylindrical lenses, i.e., lenses which have been generated to include a predetermined amount of axis as described hereinabove with particular reference to FIG. 19. Adapter chuck 270 allows the base curve or cylinder axis of the lens blank which has been so generated to be placed in alignment with the base curve of the fining and polishing apparatus lap. This aligned relationship is necessary in order to properly finish the lens blank concave surface. While the adapter chuck has been designed for particular use in fining and polishing apparatus marketed by Coburn Optical Industries, Inc., the overall general concept thereof is deemed equally applicable to the other types of fining and polishing apparatus without in any way departing from the overall intent or scope of the present invention.

More particularly, and with continued reference to all of FIGS. 20–22, the fining and polishing apparatus is only schematically shown as having a lap 272 and a pair of position and pressure pins 274,276. The lap includes a base curve r and a cross curve s generally normal to the base curve. Relative movement between the concave face of lens blank 20 and top surface of lap 272 is substantially over and along base curve r. In the type of apparatus for which the chuck has been particularly designed, the lap and base and cross curves are fixed, i.e., they do not change from lap to lap. Position and pressure pins 274,276 are a known type of retaining means and are typically used to engage a lens block for purposes of retaining an associated lens blank in the requisite position relative to lap base curve r. These two position and pressure pins are normally spaced apart from each other along an axis parallel to the lap base and do not, in and of themselves, comprise any part of the present invention.

Adapter chuck 270 includes an adapter cup or body generally designated 278 having a plurality of retaining opening pairs or sets 280,282 and 284 disposed across cup or body top wall 286. Each of these pairs or sets is adapted to receive position and pressure pins 274,276 during a lens blank fining and polishing operation. The provision of these separate sets allows more latitude in properly locating the lens blank on lap 272 to assure proper surface finishing. The openings which comprise each of sets or pairs 280,282 and 284 is located on an axis which is parallel to adapter chuck base line t. When the chuck is installed on the fining and polishing apparatus, base line t is in general parallel alignment with lap base curve r. An arcuate scale 287 is fixedly secured to top wall 286 of the adapter body for purposes of making precise angular adjustments for processing lens blanks in the fining and polishing apparatus as will be described hereinbelow. This scale conveniently extends between 0° and 180° in 1° increments and is located in top wall 286 such that base line t passes through the 0° and 180° settings. Adapter body peripheral side wall 288 includes an elongated locking shaft 290 which threadedly penetrates therethrough and which has a locking knob 292 at the outermost end thereof. The innermost end of the shaft may also advantageously include a cushion pad (not shown) constructed from nylon or some similar material. Use of this locking shaft will also become more readily apparent hereinafter.

With particular reference to the cross-sectional view of FIG. 21, the adapter body includes a cylindrical receiving cavity 294 extending inwardly thereinto from the bottom surface thereof. A cylindrical seat block 296 is dimensioned to have at least a longitudinal section thereof closely rotatably received in receiving cavity 294. In the preferred arrangement here under discussion, cavity 294 is coaxial with the longitudinal axis of adapter chuck 170 so that seat block 296 is itself rotatable about that axis. The seat block includes a circumferentially extending retaining groove 298 adjacent the upper or innermost end thereof adapted to receive seat block retaining means therein. One such retaining means comprises a retaining ball screw such as the one generally shown in FIG. 21 and designated by numeral 300. A plurality of these screws located at spaced intervals around adapter body 278 are preferred. Each screw penetrates receiving cavity 294 through adapter body side wall 288 so that the innermost end is received in groove 298. Alternative retaining means could also be advantageously employed without in any way departing from the overall intent or scope of the present invention. In addition, locking screw 290 penetrates cavity 294 for locking receipt by groove 298. A generally L-shaped axis position pointer 302 is fixedly secured to the side wall of seat block 296 so as to extend radially outward and upwardly therefrom. Indicating indicia 304 (FIG. 20) is disposed on pointer 302 in close proximity with scale 287 for purposes of indicating the rotated relationship between the adapter body and seat block.

As best shown in FIG. 22, the lower or outermost end face 306 of the seat block includes the centrally located circular recess 308 which, in turn, includes a generally T-shaped receiving opening 310 in the bottom wall thereof. Recess 308 is adated to fairly closely receive the circular portion of lens block 30 with T-shaped receiving opening 310 adapted to fairly closely receive lens block mounting tab 36 and protrusion 38. This disposition of the lens block is substantially similar to that described hereinabove with reference to FIG. 11 wherein seating plate 160 includes a circular recess 170 and a T-shaped opening 174. When the lens block is received in communication with recess 308 and opening 310 of seat block 296, longitudinal axis 37 of the lens block and frame center axis 14 of the lens blank are substantially coaxial with the adapter chuck longitudinal axis. Although adapter body 278 and seat block 296 could be constructed from a wide variety of materials, aluminum is preferred.

The various adapter chuck components described above are mounted relative to each other so that a first normal position for the chuck is defined when indicia 304 of pointer 302 is positioned adjacent the 0° position of scale 287. In this first normal position with position and pressure pins 274,276 disposed in one of opening sets or pairs 280,282,284 and with a lens block and associated lens blank properly seated within recess 308 and T-shaped opening 310, lens block mounting tab 36 (FIG. 20) is in alignment with lap base curve r. As previously described hereinabove with reference to FIGS. 1–7 for the mounting of the lens blank to the lens block, lens blank base line 18 is disposed to extend parallel to mounting tab 36. Therefore, in the adapter chuck first normal position, the lens blank base line will also be in parallel alignment with lap base curve r.

However, if axis has been incorporated into the lens blank during lens surface generation, it is necessary to adjust the lens blank relative to lap curve r by an amount equal to the axis angle to thus place the lens blank cylinder axis in alignment with the lap base curve. Such adjustment is made by simply threadedly retracting locking shaft 290 through use of knob 292 and rotating seat block 296 relative to adapter body 278 until position pointer indicia 304 is in alignment with the predetermined axis angle as indicated on scale 287. Thereafter, threaded shaft 290 may again be advanced by knob 292 into locking engagement with the seat block at groove 298 to fixedly retain seat cup 296 in position. This rotated relationship comprises a second or adjusted position for the seat block and, again, such adjustment is necessary for purposes of placing the lens blank cylinder axis in alignment with the base curve of lap 272. Thus, the angle x shown in FIG. 19 would be rotated to a position of generally parallel alignment with lap base curve r. Thereafter, the concave surface may be fined and polished in the usual known manner.

Figure 23:
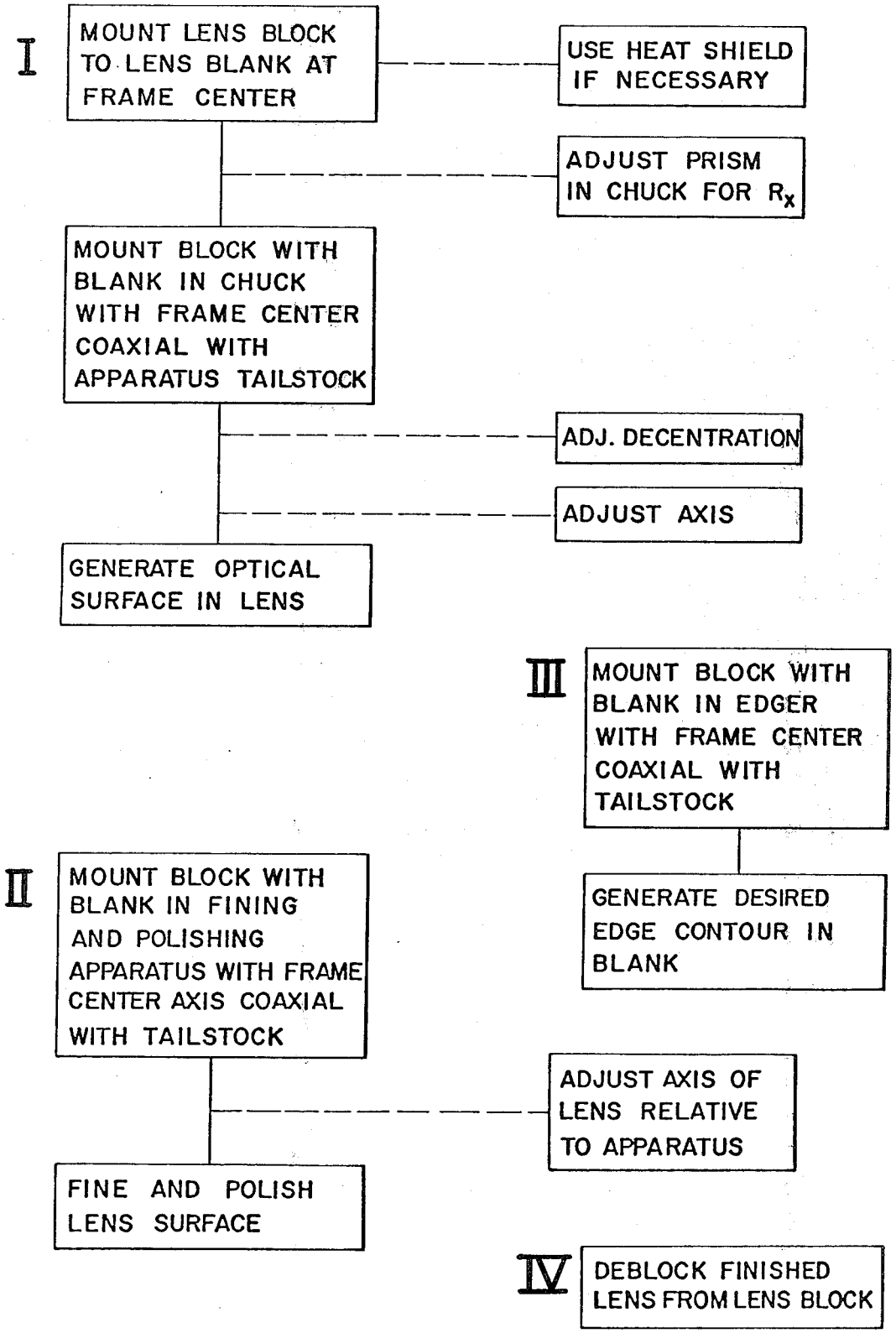

FIG. 23 comprises a flow diagram for the manufacture of eyeglass lens utilizing the above described lens blank and chuck assembly. Referring to that portion of FIG. 23 designated I, the lens block is mounted to the lens blank at frame center as hereinabove described with reference to FIG. 6. In the event plastic type lens blank is employed or it is otherwise deemed necessary or appropriate, a heat shield may be advantageously employed as described with reference to FIG. 7.

With mounting means B, that is, shaft 58, fixedly coaxially mounted in the tailstock of the lens generating apparatus as hereinabove described, any necessary adjustment as by an appropriate prism ring 260 to accommodate prism requirements for the finished lens are made to the chuck assembly as described above with reference to FIG. 18.

With the decentration and axis adjustments in the chuck set at the zero positions, the lens block with associated lens blank is mounted in the chuck assembly in a manner described with reference to FIGS. 17 and 19. If no prism is required, frame center axis 14 of the lens blank is coaxial with both housing longitudinal axis 54 and the generating apparatus tailstock. If a prism adjustment is required, axis 14 will be canted relative to axis 54. Thereafter, appropriate adjustments may be made for lens blank decentration and/or axis as also described hereinabove with reference to the same Figures. Following lens block with associated lens blank mounting and adjustment in the chuck assembly, the requisite optical surface is generated in the lens blank concave surface by bringing the apparatus generating head into operative proximity with the concave surface as is known in the art. Thereafter, the lens block with lens blank is removed from the chuck assembly for further processing steps and the chuck assembly may be made ready for the next lens block with lens blank which is to be processed.

Following surface generation and with reference to that portion of FIG. 23 identified by II, the lens block with associated lens blank is mounted in conventional fining and polishing apparatus with the frame center axis 14 of the lens blank disposed coaxial with the fining and polishing apparatus tailstock. The specific fining and polishing apparatus does not itself form a part of the present invention and may comprise typical apparatus already employed for such purposes. If no axis angle has been incorporated into the lens blank during surface generation, i.e., a spherical lens, a simple adapter unit may be advantageously employed for holding the lens block with lens blank in position on the fining and polishing apparatus. In this operation, base line 18 (FIG. 1) of the lens blank is positioned to extend in general parallel alignment with the base curve of the fining and polishing lap member as is conventional. However, in the event the clamp assembly was adjusted to include axis is hereinabove described with reference to part I of FIG. 23, i.e., a cylindrical lens, the axis of the lens block is similarly adjusted with respect to the fining and polishing apparatus. An adapter assembly such as adapter chuck 270 described hereinabove with reference to FIGS. 20–22 is advantageously used for this purpose. This axis angle of the lens blank is set on the chuck to equal the lens blank cylinder axis imparted during surface generation. Thus, this cylinder axis will be aligned parallel with the base line curve of the fining and polishing apparatus lap member. Thereafter, the concave surface of lens blank 30 is fined and polished as is known in the art. Following this operation, the lens block with associated lens blank is removed from this apparatus and moved to the next processing station.

Referring to part III of FIG. 23, lens block 30 with associated lens blank is installed in conventional edging apparatus with the lens blank frame center 14 again coaxial with the edging apparatus tailstock. Such edging apparatus is known in the art and is not, therefore, described in further detail herein. The desired peripheral edge contour 22 (FIG. 2) is then ground into the lens blank pursuant to a predetermined desired configuration. Typically, the edger employs preselected guide cams to achieve the particular edge configuration desired. Following contouring, the lens block with lens blank is removed from the edger. For all intents and purposes, lens block 10 of FIG. 1 has been transformed into finished lens 20 of FIG. 2 following edging.

Finally, and with reference to part IV of FIG. 23, finished lens 20 is deblocked from lens block 30. As noted above, the preferred embodiment contemplates use of an adhesive 40 comprised of a polyester based hot melt. Such an adhesive may be deblocked by soaking the lens block with finished lens in hot water or the like. The water may be agitated slightly in order to expedite this dissolving action. Of course, other convenient means for effecting deblocking may be uitlized to accommodate different circumstances without departing from the overall intent or scope of the present invention.

Following deblocking, the finished lens is ready for any final hand operations such as final inspection or the like and ultimate installation in a lens frame. Lens block 30 may be recovered, cleaned and then reused.

The subject lens processing method and apparatus present a substantial improvement over prior lens processing techniques in that only a single lens blocking step is required for the lens blank to accommodate all the processing required to convert it into a finished lens. In addition, the subject invention enhances lens production capabilities, is simple, reliable, is adapted to allowing substantially all desired prescription characteristics to be imparted into lens blanks for both single and multivision lenses and does not consume the lens block themselves. While the various chuck assembly adjustments for accommodating at least decentration and axis have been described above as comprising a combination of hand and mechanically driven adjustment means, it is entirely within the scope of the present invention to automate such adjustments. Indeed, it is deemed possible to control at least these adjustments by servo mechanisms or the like which may be programmed to automatically accommodate different lens prescriptions. Such modification does not depart from the overall intent or scope of the present invention.

The invention has been described with reference to the preferred embodiment. Obviously, modifications and alterations will occur to others upon the reading and understanding of this specification. It is my intention to include all such modifications and alterations insofar as they come within the scope of the appended claims or the equivalents thereof.

Having thus described my invention, I now claim:

1. An adapter chuck for use in orienting a lens blank so that a predetermined axis angle for said lens blank angularly disposed from a lens blank base line may be placed in general parallel alignment with the base curve of a lap in lens blank fining and polishing apparatus to accommodate any axis previously incorporated into said lens blank during a lens surface generating operation and wherein said lens blank has a lens block affixed thereto at the lens blank frame center axis so as to extend outwardly from the opposite lens blank face which is to be fined and polished, said adapter chuck comprising:

a generally cup-shaped adapter body having an upper end wall and a side wall with a cylindrical receiving cavity extending coaxially inward into said body from a lower end wall thereof, said upper end wall including mounting means adapted to fixedly position said adapter chuck relative to said fining and polishing apparatus and with said adapter body further including an angle measuring scale fixedly secured thereto; a generally cylindrical seat block having at least a longitudinal portion thereof received in said receiving cavity for selective rotation about the longitudinal axis of said chuck, said seat block including indicator means cooperable with said scale for indicating the relative rotated position of said seat block to said adapter body from a first normal position and a predetermined second position angularly spaced therefrom by an amount equal to said lens blank axis angle; means cooperating between said adapter body and seat block for retaining said seat block in said receiving cavity while allowing selective rotation therebetween and substantially preventing relative lateral, longitudinal and angular movement therebetween; receiving means in the outermost end wall of said seat block for receiving said lens block with said lens blank frame center axis positioned substantially coaxial with said adapter chuck longitudinal axis and with said lens block substantially fixed against lateral, angular and rotational movement relative to said seat block while being freely longitudinally separable therefrom, said lens blank base line and said lap base curve being substantially aligned parallel to each other when said chuck is fixedly positioned relative to said fining and polishing apparatus by said mounting means with said seat block in said first normal position; and, locking means penetrating said adapter body side wall and being selectively movable into and out of locking engagement with said seat block for respectively preventing and allowing relative rotation between said adapter body and seat block.

2. An adapter chuck for mounting lens blanks comprising: an adapter body having an end wall, a peripheral side wall extending from said end wall and substantially surrounding a generally cylindrical cavity, mounting means on the opposite side of said end wall from said cavity for mounting said adapter body to a spindle of a lens fining and polishing apparatus, a seat block at least partly received in said cavity, cooperating means between said adapter body and seat block for providing selective relative rotational movement therebetween while substantially preventing lateral, longitudinal and angular movement therebetween, locking means for locking said adapter body and seat block against relative rotation, said seat block having an end surface facing outwardly away from said adapter body end wall, and said end surface having socket means therein for receiving a lens block projection against relative rotational, lateral and angular movement between said seat block and the lens block.

3. The adapter chuck as defined in claim 2 wherein said seat block has an inner portion received in said adapter body cavity and an outer portion extending outwardly therefrom, and said cooperating means comprising a circumferential groove in the outer peripheral surface of said seat block inner portion and a plurality of projections extending from said adapter body side wall into said groove.

4. The adapter chuck as defined in claim 2 wherein said locking means comprises a thumb screw extending through said adapter body side wall for selective engagement with the outer periphery of said seat block.

5. The adapter chuck as defined in claim 2 wherein said socket means includes a substantialy circular recess extending inwardly of said end surface and a non-circular opening extending inwardly of said seat block from the bottom of said recess.

6. The adapter chuck as defined in claim 5 wherein said opening is substantialy T-shaped.

7. The adapter chuck as defined in claim 2 including a cooperating pointer and scale between said adapter body and seat block for referencing relative rotated positions between said adapter body and seat block, said socket means being shaped and positioned for closely receiving a projection on a lens block and automatically aligning the base line of a lens blank held by the lens block with a base curve of a lap.

8. The adapter chuck as defined in claim 7 wherein said scale is on the outer surface on said adapter body end wall opposite from said cavity and said pointer is on said seat block.

9. The adapter chuck as defined in claim 2 wherein said adapter body mounting means comprises at least one pair of spaced-apart pin receiving openings for receiving position and pressure pins, said cooperating means comprising a circumferential groove in the outer peripheral surface of said seat block and a plurality of projections extending from said side wall into said groove, and said socket means including a substantially circular recess extending inwardly of said end surface and a non-circular opening extending into said seat block from the bottom of said recess.

* * * * *